US008015957B2

(12) United States Patent
Wada et al.

(10) Patent No.: US 8,015,957 B2
(45) Date of Patent: Sep. 13, 2011

(54) APPARATUS FOR CONTROLLING VARIABLE VALVE DEVICE

(75) Inventors: Minoru Wada, Obu (JP); Yasuhiro Shikata, Kariya (JP)

(73) Assignee: Denso Corporation, Kariya, Aichi-Pref. (JP)

( * ) Notice: Subject to any disclaimer, the term of this patent is extended or adjusted under 35 U.S.C. 154(b) by 341 days.

(21) Appl. No.: 12/324,983

(22) Filed: Nov. 28, 2008

(65) Prior Publication Data

US 2009/0145380 A1 Jun. 11, 2009

(30) Foreign Application Priority Data

Dec. 7, 2007 (JP) ..... 2007-316626

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 6,431,131 | B1 | 8/2002 | Hosoya et al. | |
| 6,505,585 | B1 * | 1/2003 | Machida et al. | 123/90.17 |
| 7,004,128 | B2 | 2/2006 | Majima et al. | |
| 2006/0124093 | A1 * | 6/2006 | Kanada et al. | 123/90.17 |

FOREIGN PATENT DOCUMENTS

| | | |
|---|---|---|
| JP | 59-155541 | 9/1984 |
| JP | 2003-254098 | 9/2003 |
| JP | 2007-009791 | 1/2007 |

OTHER PUBLICATIONS

Japanese Office Action issued on May 18, 2011 in co-pending Japanese Application No. 2007-316626, with English translation.

* cited by examiner

*Primary Examiner* — Zalalem Eshete
(74) *Attorney, Agent, or Firm* — Nixon & Vanderhye PC

(57) ABSTRACT

A variable valve device modulates movement of a valve for an internal combustion engine by using hydraulic fluid pressure. The variable valve device is controlled by a control device via a control valve that modulates hydraulic fluid pressure supply to and discharge from the variable valve device. The control device offsets an operating amount of the control valve by an offset component that shifts the operating amount outside a dead band. The control device sets the offset component smaller as the hydraulic fluid temperature increases. The control device sets the offset component smaller when a controlling direction coincides with a biasing direction of a biasing member than that when the controlling direction opposes the biasing direction. Further, the control device cancels the offset component when actual valve movement is sufficiently close to target valve movement.

16 Claims, 8 Drawing Sheets

APPARATUS FOR CONTROLLING VARIABLE VALVE DEVICE

CROSS REFERENCE TO RELATED APPLICATION

This application is based on Japanese Patent Application No. 2007-316626 filed on Dec. 7, 2007, the contents of which are incorporated herein by reference in its entirety.

FIELD OF THE INVENTION

The present invention relates to an apparatus for controlling a variable valve device that varies valve movement by using a hydraulic pressure as a power source.

BACKGROUND OF THE INVENTION

Conventionally, the number of internal combustion engines equipped with a variable valve device is increasing. Hereinafter, the internal combustion engine is referred to as an engine. The variable valve device is installed in a drive train from a crankshaft to a camshaft that mechanically operates at least one of an intake valve and an exhaust valve. The variable valve device modulates or varies valve movement, such as valve opening timing, valve closing timing, valve timing, and valve lift. In one of the variable valve devices, the variable valve device is powered by fluid, such as oil, supplied by the engine. The variable valve device may be considered as a hydraulic actuator. The variable valve device is installed in the drive train so as to change the camshaft position in a rotational direction or an axial direction. For controlling the variable valve device, a control valve may be disposed in oil lines through which the fluid is supplied or discharged.

A variable valve timing device is sometimes known as a variable valve device. The variable valve timing device is referred to as a VVT. The VVT may be also referred to as a variable cam timing device, a VCT, since it changes a phase difference of the camshaft with respect to the crankshaft of the engine. The VVT varies valve timing for at least one of an intake valve and an exhaust valve in the engine. Valve timing means at least one of opening timing and closing timing of the valve. In a simple configuration of the VVT, since the VVT shifts the phase of the camshaft, both the opening and closing timings are shifted simultaneously. The VVT is also considered as a hydraulic actuator of which fluid supply is controlled by the control valve. The control valve may include a duty driven actuator which adjusts opening and closing conditions of the valve in accordance with a central signal duty cycle value A control apparatus for the VVT calculates the duty cycle value of the control signal so that the control signal adjusts the control valve to make actual valve timing approach a target valve timing. For this purpose, the controller may use a conventional feedback control method, in which the duty cycle value can be obtained based on a difference between target valve timing and actual valve timing. In a preferred arrangement, the VVT has an advancing chamber and a retarding chamber. The oil is supplied to the advancing chamber when the valve timing is advancing and is discharged from the advancing chamber when the valve timing is retarding. The oil is supplied to the retarding chamber when the valve timing is retarding and is discharged from the retarding chamber when the valve timing is advancing. The control valve switches between a supplying mode and a discharging mode, and adjusts an amount of supplying or discharging. The control valve may be provided by a plurality of electromagnetic valves or a multi-port spool valve. The control valve complementarily switches the modes for the advancing chamber and the retarding chamber. In the case of the multi-port spool valve, the modes are switched in response to the duty cycle value of the control signal. The amount of fluid may be referred to by its oil pressure. As a result, the VVT advances or retards the actual valve timing.

JP2001-164964A, U.S. Pat. No. 6,431,131, JP2007-107539A, and U.S. Pat. No. 7,004,128 disclose VVTs. The disclosed VVTs have a dead band on a response characteristic. In one typical response characteristic, a characteristic between the duty cycle value and a changing speed of the valve timing appears as a non-linear characteristic that includes the dead band. In the dead band, the changing speed of the valve timing is almost 0 (zero) or significantly slow compared to outside of the dead band. In other words, in the dead band, the changing speed of valve timing is slow with respect to a changing amount of the duty cycle value compared to outside of the dead band. Therefore, the VVT demonstrates no response or significantly slow response in the dead band.

In order to overcome such disadvantage, JP2001-164964A and U.S. Pat. No. 6,431,131 disclose a sliding mode control method. According to the disclosure, the controller calculates a control amount by using the following steps during deviation between target valve timing and actual valve timing that falls within a range of the dead band. A feedback control amount is calculated by the sliding mode control method. A fundamental control amount, base duty cycle amount, is corrected based on a steady deviation between target valve timing and actual valve timing. Then, the control amount for a control valve is set by summing the fundamental control amount and the feedback control amount.

In order to overcome a disadvantage of the dead band, JP2007-107539A and U.S. Pat. No.7,004,128 disclose several methods. According to the disclosure, the duty cycle, value for a control valve is oscillated. Further, the duty cycle value for the control valve is offset in accordance with a dead band width that is a width of the dead band indicated by a difference of duty cycle values. Alternatively, a control gain is increased within the dead band.

SUMMARY

Characteristics of a control valve, such as an oil control valve, may be determined by a characteristic of flow amount, which indicates a relationship between a control signal and a flow amount of fluid through the control valve. In the case of using the oil as the hydraulic fluid, the flow characteristic is varied in accordance with oil viscosity. For example, the flow characteristic is increased in the flow amount as oil temperature increases, since oil viscosity is decreased as oil temperature increases.

Since the flow amount may be observed as a changing speed of the VVT, a response characteristic of the VVT, which is indicated by the duty cycle value of the control signal and the changing speed of the VVT. Therefore, the characteristic of the control valve may be evaluated by observing the response characteristic of the VVT with the control valve. The response characteristic may also partially reflect an amount of leakage in the VVT.

FIGS. 3, 4A, and 5A show response characteristics in a high oil temperature and a low oil temperature. The high oil temperature corresponds to a temperature where the engine is fully warmed up, e.g., 80° C. (eighty degrees of Celsius). The low oil temperature, contrary, corresponds to a temperature just after the engine is started, e.g., −10° C. (minus ten degrees of Celsius). The high and low oil temperatures may be determined and varied in the purpose of the engine, e.g., the engine for the vehicle. In the low oil temperature, the dead bands are relatively wide compared to the dead band in the high oil temperature. The dead band width becomes narrower as the oil temperature increases, since the flow characteristic of the control valve is improved as the oil temperature increases.

Although the dead band varies with respect to the oil temperature, above described prior arts do not consider the oil temperature. Therefore, an improvement in the response of the VVT may be insufficient. For example, in case that the oil temperature is higher than expected, the control signal may be excessively corrected, and the actual valve timing may overshoot excessively from the target valve timing. In case that the oil temperature is lower than expected, the control signal may be less corrected, and a response of the VVT is slow.

In view of the foregoing problems, it is an object of the present invention to provide a variable valve device having an improved response in both the high temperature and low temperature of the hydraulic medium supplied to the variable valve device.

It is another object of the present invention to provide a variable valve device having an improved response irrespective of temperature of the hydraulic medium supplied to the variable valve device.

It is another object of the present invention to provide a variable valve device capable of being a proper dead band correction in accordance with the temperature of the hydraulic medium supplied to the variable valve device.

An embodiment of the invention provides a variable valve device system. The system comprises a variable valve device for modulating movement of a valve for internal combustion engine by using a hydraulic pressure, a control valve operatively connected with the variable valve device to control supplying to and discharging from the hydraulic pressure, and a control device operatively connected with the control valve to control an actual valve movement to a target valve movement by operating the control valve. The control device includes means for detecting or estimating a temperature of hydraulic medium, means for setting an offset component in accordance with the hydraulic medium temperature, and means for offsetting an operating amount of the control valve by the offset component.

According to the embodiment, it is possible to set a proper amount for the offset component, since the offset component is set in accordance with the hydraulic medium temperature. As a result, it is possible to achieve improved responses in both the high temperature and low temperature of the hydraulic medium.

In one of preferred embodiments, the offset component setting means may set the offset component in order to shift the operating amount outside a dead band where a changing speed of the variable valve device is relatively slow with respect to the operating amount of the control valve. The offset component setting means may set the offset component smaller as the hydraulic medium temperature increases.

In one of preferred embodiments, the control device may further include means for detecting at least one of engine rotational speed of the internal combustion engine and load of the internal combustion engine; and means for varying the offset component in accordance with at least one of the engine rotational speed and the load.

In one of preferred embodiment, the offset component setting means may set the offset component differently depending on controlling directions.

In one of preferred embodiment, the variable valve device may include a biasing member that biases the variable valve device in a biasing direction that is one of the controlling directions. The offset component setting means may set the offset component smaller when the controlling direction coincides with the biasing direction than that when the controlling direction opposes to the biasing direction.

In one of preferred embodiment, the variable valve device may be a variable valve timing device including the biasing member that biases the variable valve timing device in one of an advancing direction and a retarding direction.

In one of preferred embodiment, the control device may further include means for canceling the offsetting of the operating amount by the offset component when a difference between the actual valve movement and the target valve movement is in a predetermined range. It is possible to prevent an oscillatory behavior at a range close to the target valve movement.

In one of preferred embodiment, the canceling means may vary the predetermined range in accordance with at least one of a temperature of the hydraulic medium, an engine rotational speed of the internal combustion engine, and a load of the internal combustion engine.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

First Embodiment

A first embodiment of the invention is described below with the drawings. The first embodiment is a variable valve timing system. The variable valve timing system is referred to as a VVT system. The VVT system includes a hydraulic system and an electronic control system as a control device.

The hydraulic system includes at least one variable valve timing device as a variable valve device, a hydraulic source and control valves. The WT uses a hydraulic pressure to modulate a movement of a valve. The electronic control system for the VVT system includes a plurality of sensors, a control unit and a plurality of actuators. The control valve acts as the actuator.

Figure 1:
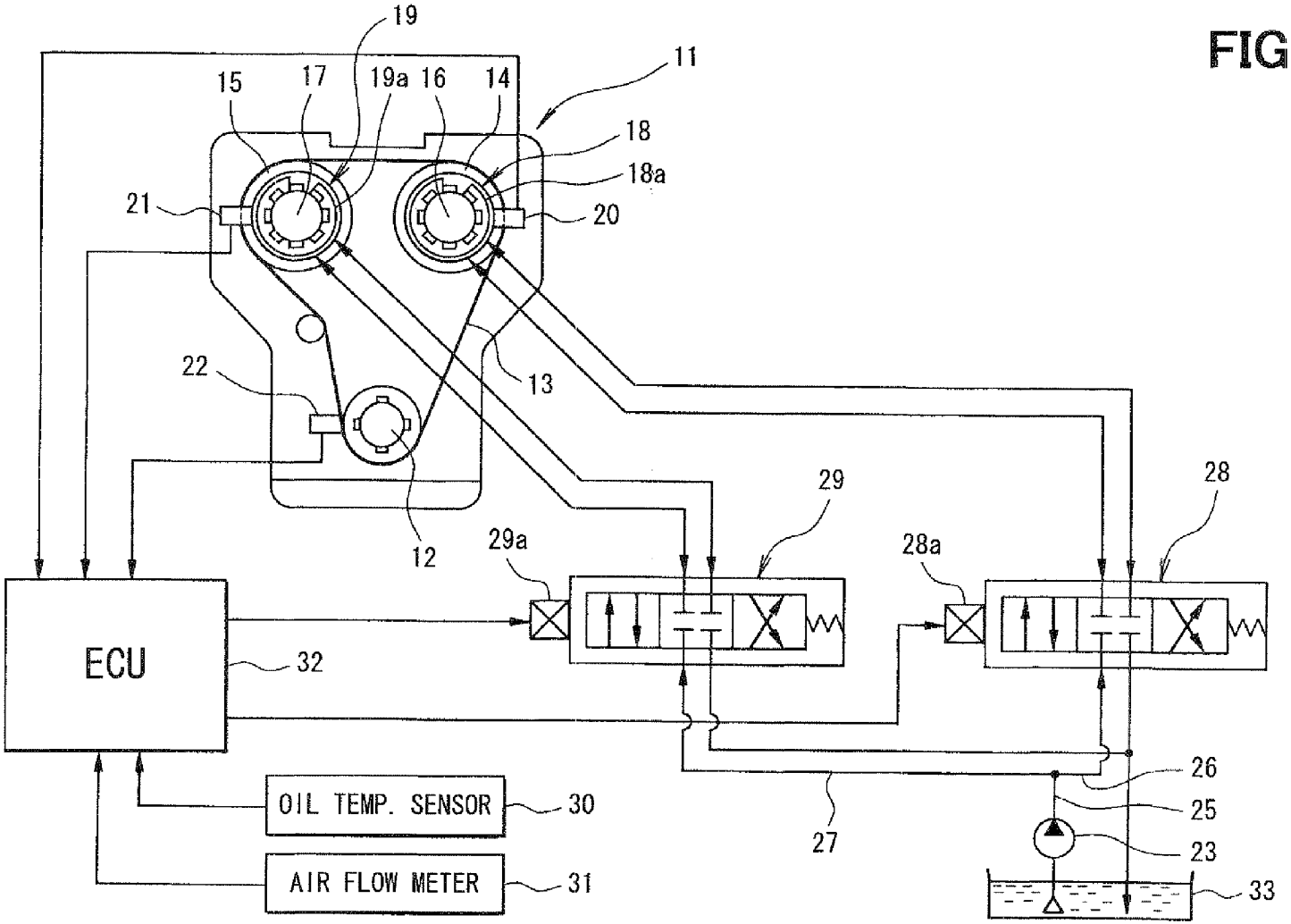
FIG. 1 is a block diagram of variable valve timing system according to a first embodiment of the present invention.

Referring to FIG. 1, a configuration of the VVT system is described. FIG. 1 shows a block diagram of the VVT system. The engine 11 is an internal combustion engine having a crankshaft 12. The crankshaft 12 has a crank sprocket engaged with a timing chain 13. The timing chain 13 is also engaged with cam sprockets 14 and 15 respectively. The cam sprocket 14 is coupled with an intake camshaft 16 via a VVT 18. The cam sprocket 15 is coupled with an exhaust camshaft 17 via a VVT 19. The crank sprocket, the timing chain 13 and the cam sprocket 14 provides a drive train for the intake camshaft 16. The crank sprocket, the timing chain 13 and the cam sprocket 15 provides a drive train for the exhaust camshaft 17. The intake camshaft 16 mechanically opens and closes at least one intake valve. The exhaust camshaft 18 mechanically opens and closes at least one exhaust valve. Hereinafter intake is abbreviated IN. The exhaust is abbreviated EX. For example, the intake camshaft 16 is referred to as the IN-camshaft 16. The exhaust VVT 19 is referred to as the EX-VVT 19.

The IN-VVT 18 varies a valve timing including both the opening and closing timings of the IN-valves by changing rotational phase of the IN-camshaft 16 with respect to the crankshaft 12. The IN-VVT 18 advances the valve timing from an initial position, e.g., the most retarded position, for the IN-valves.

The EX-VVT 19 varies a valve timing including both the opening and closing timings of the EX-valves by changing rotational phase of the EX-camshaft 17 with respect to the crankshaft 12. The EX-VVT 19 retards the valve timing from an initial position, e.g., the most advanced position, for the EX-valves.

An IN-angle sensor 20 is disposed outside the IN-camshaft 16. The IN-angle sensor 20 generates an IN-angle signal characterized by pulses generated at predetermined rotational positions of the IN-camshaft 16. An EX-angle sensor 21 is disposed outside the EX-camshaft 17. The EX-angle sensor 21 generates an EX-angle signal characterized by pulses generated at predetermined rotational positions of the EX-camshaft 17. A crank angle sensor 22 is disposed outside the crankshaft 12. The crank angle sensor 22 generates a crank angle signal characterized by pulses generated at predetermined rotational positions of the crankshaft 12. The crank angle sensor 22 may be referred to as an engine rotational speed sensor, since an engine rotational speed is calculated based on a period of time between the pulses on the crank angle signal.

Each of the IN-VVT 18 and the EX-VVT 19 is a hydraulic actuator having advancing chamber and a retarding chamber variable in volume in accordance with the valve timing, i.e., the rotational phase of respective camshaft with respect to the crankshaft 12. The chambers are defined between a member engaged with the cam sprocket and a member engaged with the camshaft so that the volumes of the chambers are varied in accordance with the valve timing. Applicable embodiments of the VVTs 18 and 19 are disclosed and described in U.S. Pat. No. 6,431,131 and U.S. Pat. No. 7,004,128, and which are incorporated herein by reference.

The hydraulic source includes an oil pump 23. The oil pump 23 is driven by the engine 11, i.e., the crankshaft 12. The oil pump 23 discharges oil to a discharge passage 25. The discharge passage 25 is divided into supply passages 26 and 27. The supply passage 26 is communicated with a supply port of a control valve 28 for the IN-VVT 18. The other supply passage 27 is communicated with a supply port of a control valve 29 for the EX-VVT 19. The hydraulic source includes two lines for the IN-VVT 18 and the EX-VVT 19. The oil pump 23 draws oil from an oil reservoir 33 and supplies oil to both the control valves 28 and 29. The oil pump 23 is commonly used for both two lines for the control valves 28 and 29. The oil as a hydraulic medium is lubricating oil for the engine 11.

Each of the control valves 28 and 29 is operatively connected with corresponding one of the VVTs 18 and 19 via hydraulic passages. Each of the control valves 28 and 29 is an electromagnetic valve. More specifically, each of the control valves 28 and 29 is a multi-port spool valve with an electromagnetic actuator. Each of the control valves 28 and 29 has the supply port communicated with the oil pump 23, a drain port communicated with the oil reservoir 33, a first output port communicated with the advancing chambers, and a second output port communicated with the retarding chambers. Each of the control valves 28 and 29 has a movable spool as a movable valve body. The spool cooperates with a valve housing defining a plurality of ports, and provides three communicating modes illustrated depending on its position. The control valve 28 has a solenoid 28*a* for displacing the spool to switch the modes illustrated. The control valve 29 has a solenoid 29*a* for displacing the spool to switch the modes illustrated. Each of the solenoids 28*a* and 29*a* is supplied with a control signal. The control signal is switched between a high level and a low level with a duty value. Current flowing through respective one of the solenoids 28*a* and 29*a* is increased as the duty of the control signal is increased. The displacement of the spool is controlled, i.e., the modes illustrated is selected and switched, in accordance with the duty value of the control signal. Each of the control valves 28 and 29 controls flow amount of oil supplied to and discharged from the advancing and the retarding chambers. As a result, each of the VVTs 18 and 19 is adjusted in a desired position where desired valve timing is achieved.

An oil temperature sensor 30 is disposed on a specific position of the hydraulic source between the oil reservoir 33 and the VVTs 18 and 19. The oil temperature sensor 30 detects an oil temperature directly. The oil temperature is detected as a parameter indicative an oil viscosity.

Alternatively, instead of the oil temperature sensor 30, it is possible to detect or estimate the oil temperature indirectly. The oil temperature may be estimated based on at least one of parameters correlative to the oil temperature. For example, a temperature of cooling water for the engine 11, an elapsed time from starting the engine 11, or an operating condition of the engine 11 can be used for estimating the oil temperature.

The sensors further include a load detecting sensor for detecting a load on the engine 11. The load detecting sensor may be provided by an air flow meter 31 for detecting an amount of air flowing in an intake passage of the engine 11 and/or an intake passage pressure sensor for detecting a pressure in the intake passage of the engine 11. The air flow meter 31 and/or the intake passage pressure sensor may be disposed in an intake passage of the engine 11.

The electronic control unit is referred to as an ECU 32. The sensors 20, 21, 22, 30, and 31 are connected with the ECU 32. The sensor signals are fed into the ECU 32. The ECU 32 is also connected with actuators including the solenoids 28*a* and 29*a*. The ECU 32 is operatively connected with the control valves 28 and 29 respectively. The ECU 32 is mainly configured with a microcomputer that controls engine components, such as an amount of fuel supplied by a fuel injection system and an ignition timing by a spark ignition system, by executing programs stored in a memory device, such as a read only memory embedded.

The ECU 32 further controls the VVT system by executing a control program for the variable valve timing system. The ECU 32 controls both the IN-VVT 18 and EX-VVT 19 so that each of the actual valve timing is adjusted to the target valve timing. In order to regulate the actual valve timing to the target valve timing, the ECU 32 varies and controls the duty value of the control signal by using a feedback control method. In the feedback control, the PD feedback based on a difference between the actual valve timing and the target valve timing is used. The ECU 32 calculates a control duty DUTY. The control duty DUTY is an operating amount for one of the control valve 28 and 29. The control duty DUTY is sum of a feedback component Dfb, a holding component Dhd, and an offset component Dos. The control duty DUTY is obtained by an expression DUTY=Dfb+Dhd+Dos.

The feedback component Dfb is obtained by the PD feedback explained above. The holding component Dhd is a duty value which is required to hold the actual valve timing on the target valve timing. The holding component Dhd is obtained by a learning processing. In the learning processing, the ECU 32 monitors the control duty DUTY and stores the control duty DUTY as a holding component, when the actual valve timing is stably held at the target valve timing. The learning processing can eliminate manufacturing tolerances among the VVTs. Alternatively, the holding components Dhd may be obtained as a fixed value that is predetermined.

The offset component Dos is set for improving a response of the actual valve timing at the dead band, since the response, the changing speed of the actual valve timing, is slow in the dead band. The offset component Dos shifts and offsets the control duty DUTY in accordance with the dead band width. As a result, the control duty DUTY is shifted to an outside of the dead band, and the actual valve timing is changed quickly.

The flow amount characteristic of the hydraulic system may vary depending on the oil viscosity. Specifically, the flow amount characteristic of the control valves 28 and 29 is also varied depending on the oil viscosity. As the oil temperature increases, the fluidity of oil increases, since the oil viscosity decreases. As the oil temperature increases, the flow amount characteristic of the control valves 28 and 29 is improved. The response characteristic showing a relationship between the duty value supplied to one of the control valves 28 and 29 and the changing speed of one of the VVTs 18 and 19 may reflect the flow characteristic of the hydraulic system, especially the flow characteristic of the control valve.

Figure 3:
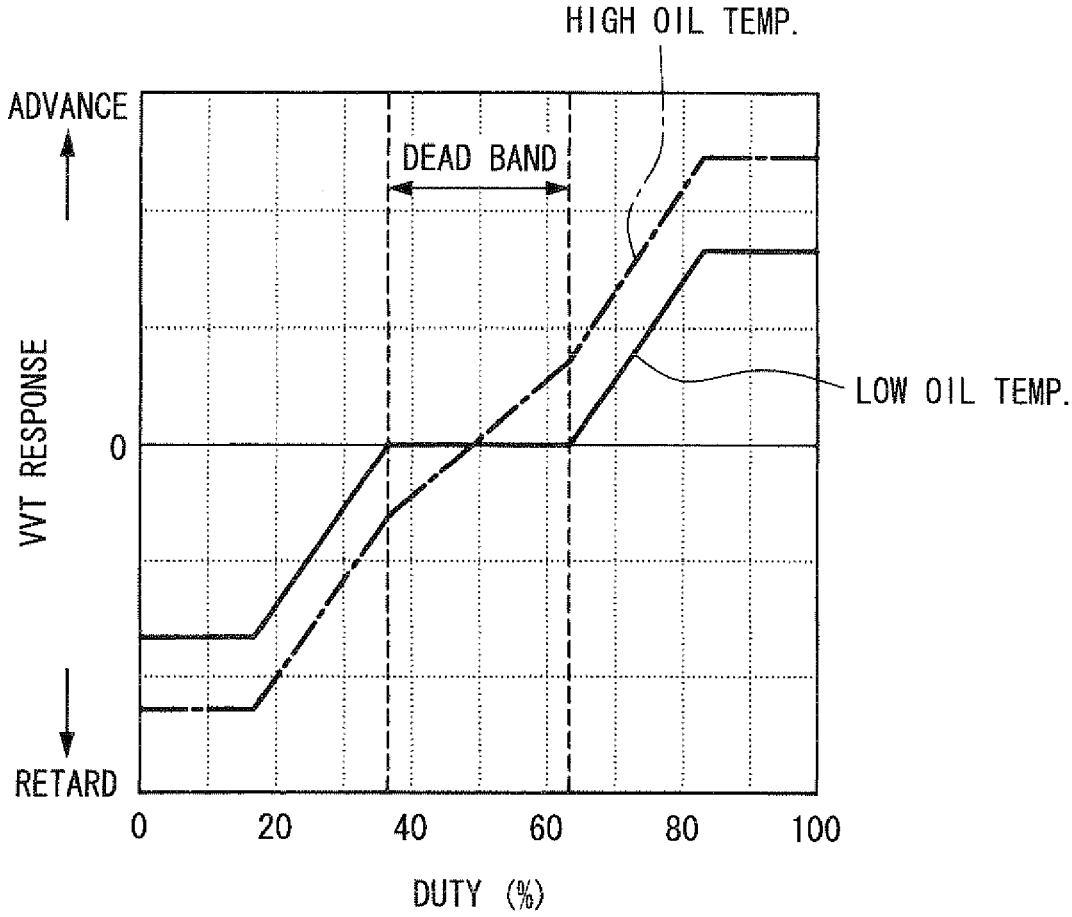
FIG. 3 is a graph showing response speeds of the variable valve timing device in high and low oil temperature conditions.
Figure 4A:
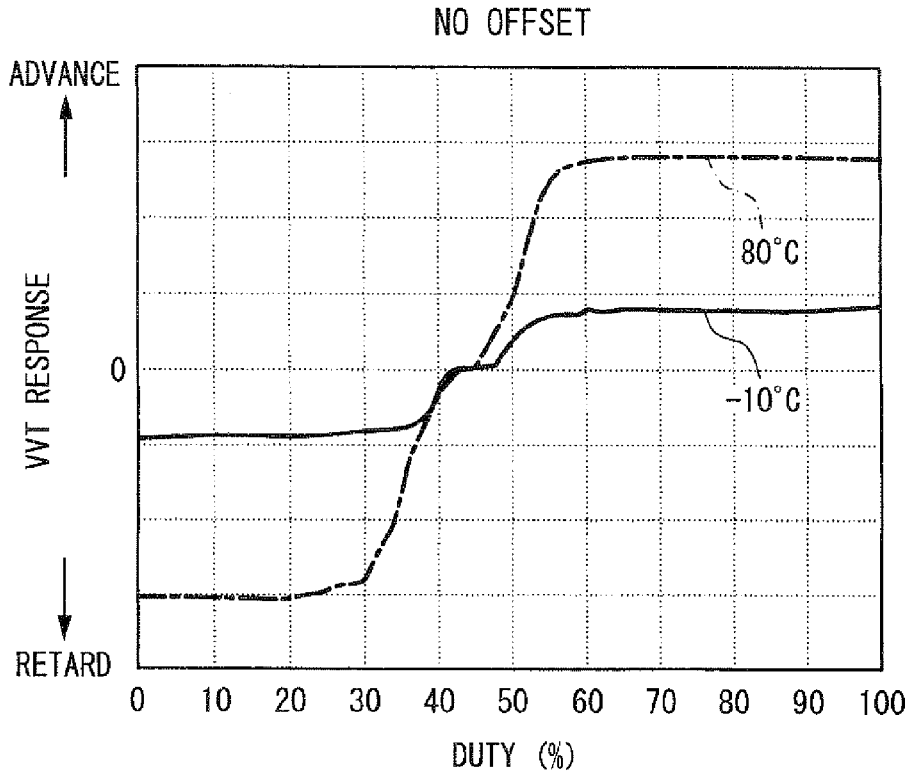
FIG. 4A is a graph showing response speeds of the variable valve timing device in high and low oil temperature conditions.
Figure 4B:
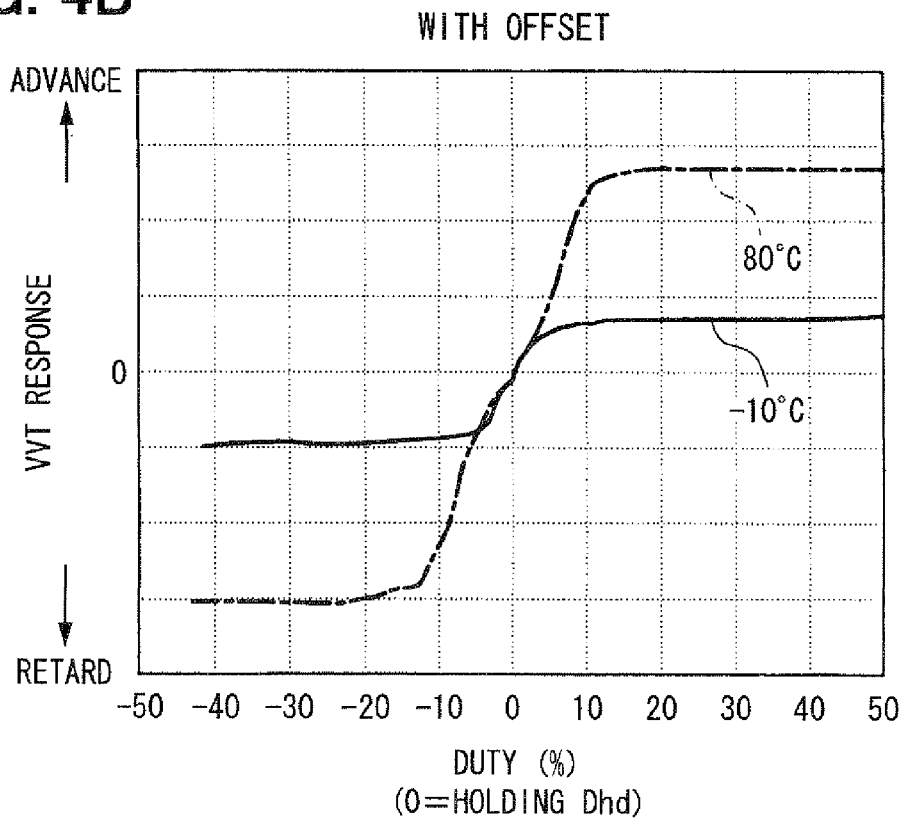
FIG. 4B is a graph showing response speeds of the variable valve timing device in high and low oil temperature conditions.
Figure 5A:
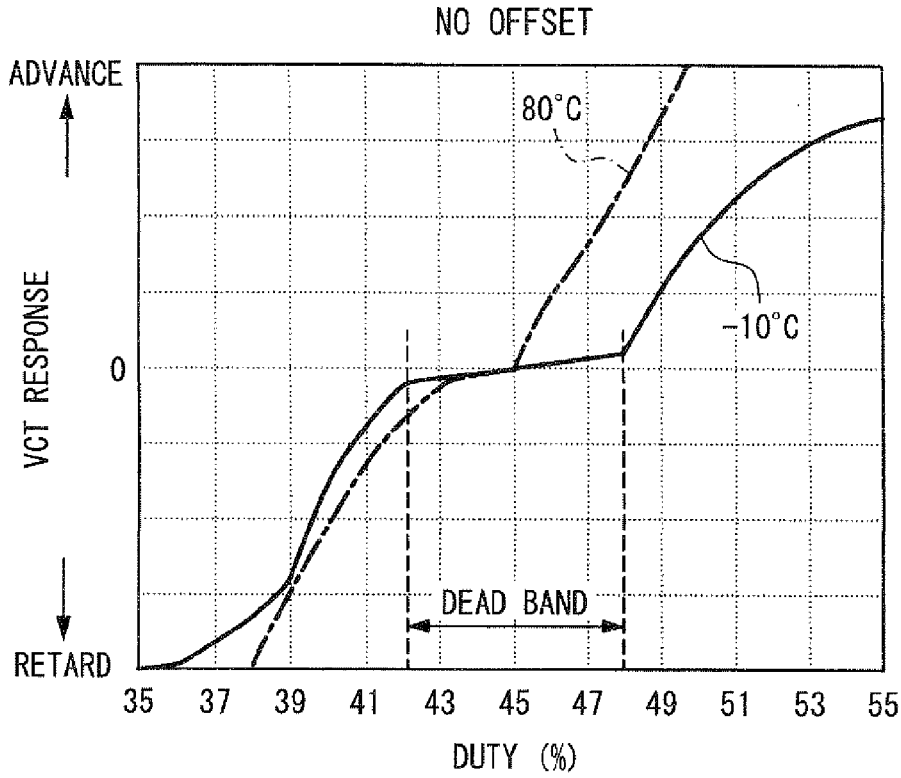
FIG. 5A is a graph showing response speeds of the variable valve timing device in high and low oil temperature conditions.
Figure 5B:
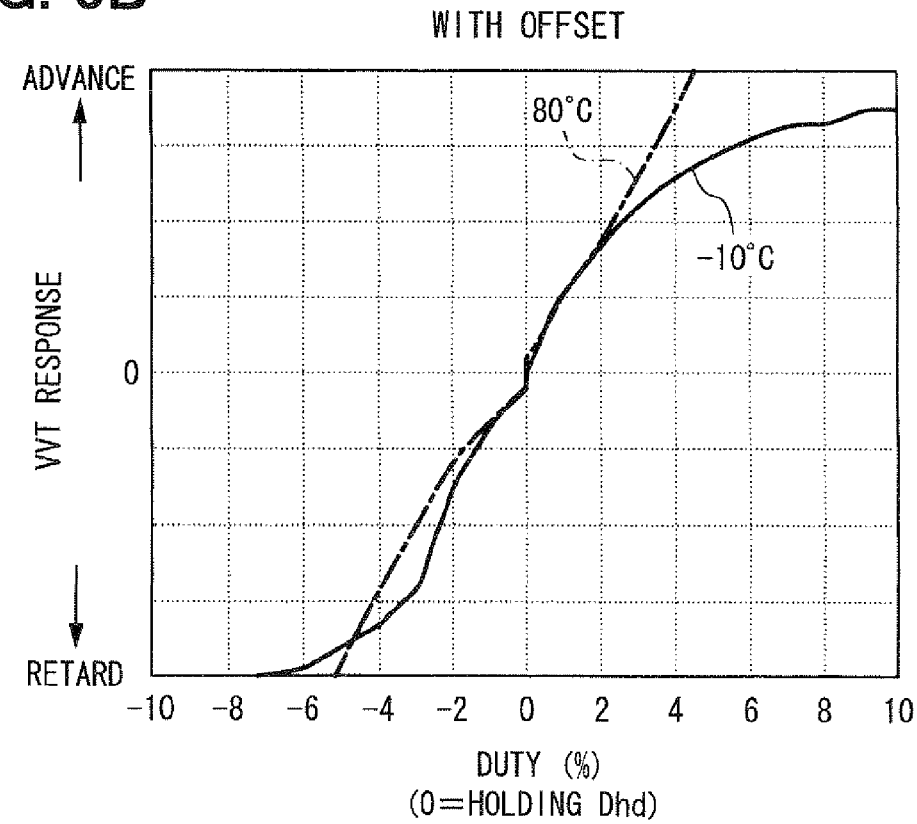
FIG. 5B is a graph showing response speeds of the variable valve timing device in high and low oil temperature conditions.

FIGS. 3, 4A, 4B, 5A and 5B show the response characteristics in a high oil temperature and a low oil temperature. FIG. 3 shows responses in a simplified fashion. FIG. 4A shows responses without variable offset component depending on the oil temperature. FIG. 4B shows responses with variable offset component depending on the oil temperature. FIG. 5A shows enlarged view of the center region of FIG. 4A. FIG. 5B shows enlarged view of the center region of FIG. 4B. In the low oil temperature, the dead bands are relatively wide compared to the dead bands in the high oil temperature. The dead band width becomes narrower as the oil temperature increases, since the flow characteristic of the control valve is improved as the oil temperature increases.

As Explained above, according to the measures to cope with the dead band in the prior arts, it is not taken into account that the dead band width is varied depending on the oil temperature. Therefore, an improvement in the response of the VVT may be insufficient. For example, in case that the oil temperature is higher than expected, the control signal may be excessively corrected, and the actual valve timing may overshoot excessively from the target valve timing. In case that the oil temperature is lower than expected, the control signal may be less corrected, and a response of the VVT is slow.

In order to address the disadvantages, in the embodiment, the ECU 32 provides means for offsetting the control duty by the offset component. The ECU 32 performs the following measure, first, an offset component is obtained by a map in accordance with the oil temperature detected by the oil temperature sensor 30, then, the control duty DUTY on the control signal is shifted or offset by the offset component obtained.

Further, in the embodiment, it is taken into account that the dead band width varies depending on the operating condition of the engine 11, such as the engine rotational speed and the load of the engine 11. The offset component is varied in accordance with the engine rotational speed and the load of the engine 11.

The IN-VVT 18 usually includes a biasing member, such as a spring 18*a*, that biases the IN-VVT 18 in a retarding direction to make it home to the initial position, such as the most retarded position, when the engine 11 is stopped. The EX-VVT 19 usually includes a biasing member, such as a spring 19*a*, that biases the EX-VVT 19 in an advancing direction to make it home to the initial position, such as the most advanced position, when the engine 11 is stopped. Therefore, the changing speed of one of the VVTs 18 and 19 is increased by a biasing force of the biasing member, when the biasing direction of the biasing member is the same as a changing direction of the valve timing by supplying and discharging hydraulic oil. The changing direction may be called as a controlling direction by the control valve. The changing speed of one of the VVTs 18 and 19 is decreased by the biasing member, when the biasing direction is opposite to the changing direction. As a result, the dead band width is narrower when the biasing direction coincides with the changing direction than that when the biasing direction opposes to the changing direction.

To consider such the characteristics of the dead band width, in the embodiment, the ECU 32 stores two maps having different characteristics and obtains the offset component using one of maps selected based on the changing direction. The maps are selectively used depending on the changing direction, an advancing direction or a retarding direction.

Figure 6:
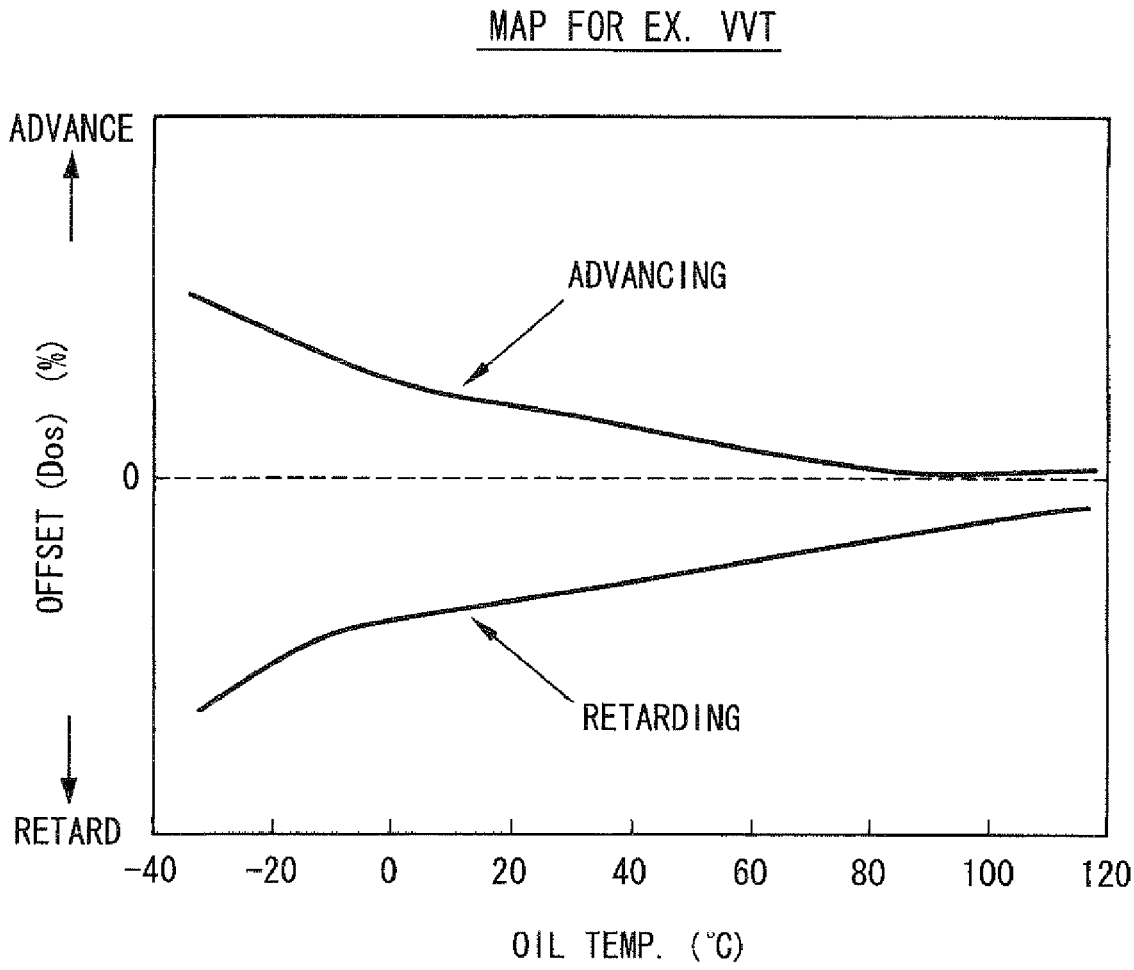
FIG. 6 is a map showing an offset value in accordance with the first embodiment of the present invention.

FIG. 6 is a graph showing value of the offset component for the EX-VVT 19 set in the maps. The graph shows value of the offset component in the advancing direction and value of the offset component in the retarding direction.

The EX-VVT 19 is biased in an advancing direction to reverse the valve timing to the initial position, e.g., the most advanced position, by the spring, when the engine 11 is stopped. Therefore, on the response of the EX-VVT 19, the dead band width when advancing the valve timing is narrower than that when retarding the valve timing. The values set in the maps are different in accordance with the dead band width that varies depending on the changing direction. For example, for the purpose of setting the offset component for the EX-VVT 19, the value of the offset component in the advancing direction is smaller than the value of the offset component in the retarding direction.

Referring to FIG. 6, the offset component in the biasing direction, the advancing direction for the EX-VVT 19, always has an absolute value that is smaller than that in the opposite direction to the biasing direction. The ECU 32 further has maps of the offset component for the IN-VVT 18. The maps for the IN-VVT 18 may obtain a greater value for the offset component in the advancing direction than that in the retarding direction.

Referring to FIG. 6, the offset component is set to have a value that shifts and offset the control duty DUTY in corresponding directions to change the actual valve timing in the changing direction, the controlling direction, such as the advancing direction or the retarding direction. The offset component in the advancing direction is set to have a positive value that shifts and increases the control duty DUTY to change the actual valve timing in an advancing direction. The offset component in the retarding direction is set to have a negative value that shifts and decreases the control duty DUTY to change the actual valve timing in a retarding direction.

The absolute value of the offset component is decreased as the oil temperature increases. The absolute value of the offset component in the advancing direction is decreased as the oil temperature increases. The absolute value of the offset component in the retarding direction is decreased as the oil temperature increases.

In a case that the actual valve timing is controlled approximately to the target valve timing, the actual valve timing shifts and deviates from the target valve timing in either the advancing direction or the retarding direction alternately. Since the feedback control method calculates a basic controlling direction in response to such a deviation, the basic controlling direction calculated by the ECU 32 could be alternately switched in the advancing direction or the retarding direction. If the ECU 32 could add the offset component in either the advancing direction or the retarding direction in response to such an alternately switching basic controlling direction, the control could be likely to show an oscillatory behavior that may be considered instable control.

In order to avoid such an oscillatory behavior caused by the offset component, in the embodiment, the offsetting function on the control signal is canceled by setting the value of the offset component to 0 (zero) when a difference between the target valve timing and the actual valve timing is in a predetermined range. The predetermined range may be set smaller than the dead band. Therefore, even if the basic controlling direction is switched in the advancing direction and the retarding direction, the control duty DUTY is not shifted and offset, when the actual valve timing is controlled close to the target valve timing. As a result, it is possible to avoid the oscillatory behavior.

In the embodiment, the ECU 32 provides an offsetting means block that offsets the control duty DUTY by the offset component varied with respect to the oil temperature. Also, the ECU 32 provides a cancelling means block that cancels the offsetting function provided by the offsetting means block when the actual valve timing is sufficiently close to the target valve timing, e.g., a difference between the actual valve timing and the target valve timing is in the predetermined range in which it is not required to accelerate the changing speed of the valve timing.

As a response of the valve timing control is improved, the oscillatory behavior becomes likely to be observed, when the actual valve timing is close to the target valve timing. The response of the valve timing control is affected by an operating condition, such as the oil temperature, the engine rotational speed, and the load on the engine 11. In order to reliably avoid the risk of the oscillatory behavior, in this embodiment, the predetermined range for canceling the offsetting function is varied in accordance with a parameter that may affect the oscillatory behavior. The parameter is the oil temperature. The parameter could be at least one of the oil temperature, the engine rotational speed, and the load on the engine 11. Alternatively, the predetermined range could be a predetermined fixed range. The predetermined range could be obtained by a threshold value, or a set of an upper limit and a lower limit.

By using such a variable range depending on the operating condition, it is possible to improve response of the variable valve control in a range where the oscillatory behavior would be hardly observed. For example, the predetermined range for cancelling the offsetting function is set wider or narrower depending on whether the operating condition, such as the oil temperature, the engine rotational speed, and the load, is in a range where the oscillatory behavior would be likely occur. The predetermined range is set wider when the operating condition is in the range where the oscillatory behavior would be likely occurring. It is possible to reliably avoid the instable control behavior and the oscillatory behavior. The predetermined range is set narrower when the operating condition is in the range where the oscillatory behavior would be hardly occurring. It is possible to accelerate the response of the valve timing control.

Figure 2:
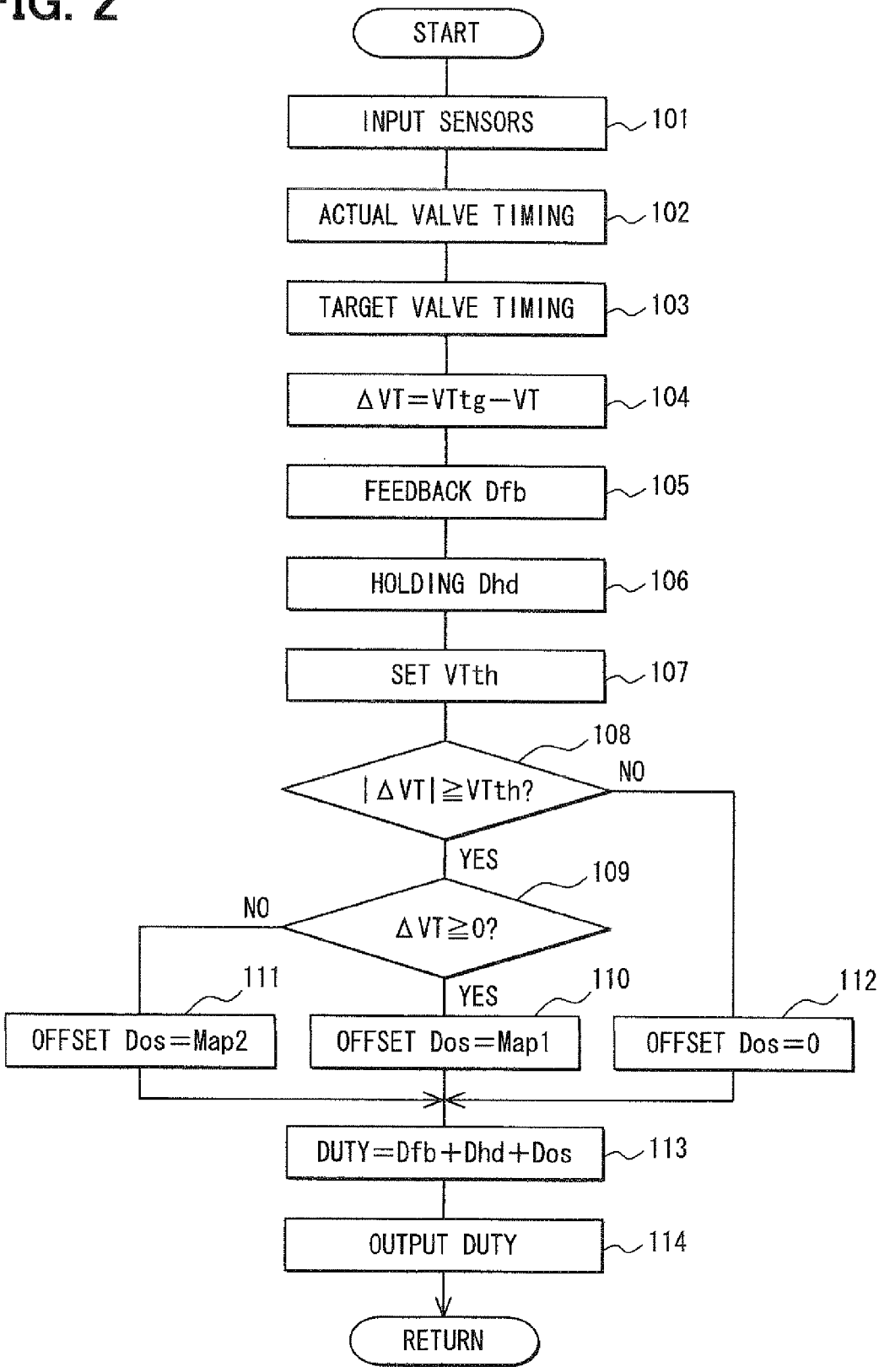
FIG. 2 is a flowchart showing a control program for the variable valve timing system according to the first embodiment of the present invention.

The valve timing control explained above is performed by carrying out a program shown in FIG. 2 by the ECU 32. The program is carried out repeatedly in a predetermined interval or a predetermined crank angle during the engine 11 is running. The program and the ECU 32 provide a control means. The ECU 32 carries out similar processing for the IN-VVT 18 and the EX-VVT 19. The program shows common parts of processing for the IN-VVT 18 and the EX-VVT 19. The ECU 32 may have parts of processing different in detail for the IN-VVT 18 and the EX-VVT 19.

In a step 101, the ECU 32 inputs sensor signals. In a step 102, the ECU 32 calculates the actual valve timing VT at this event. In a step 103, the ECU 32 calculates a target valve timing VTtg in accordance with the operating condition of the engine 11. The target valve timing VTtg is set to operate the engine 11 in a proper condition to generate sufficient power, to clean exhaust gas and to conserve fuel economy. In a step 104, the ECU 32 calculates a difference ΔVT (Delta VT) between the target valve timing VTtg and the actual valve timing VT by an expression such as $\Delta VT = VTtg - VT$.

In a step 105, a feedback component Dfb is calculated based on the difference ΔVT by using a PD feedback method. For example, the feedback component Dfb can be obtained by an expression $Dfb = Kp \cdot \Delta VT + Kd \cdot d(\Delta VT)/dt$. In the expression, it is possible to express $d(\Delta VT)/dt = (\Delta VT(i) - \Delta VT(i-1))/dt$. In the expressions above, dt is an interval for calculation events, Kp is a proportional gain, Kd is a differential gain, $\Delta VT(i)$ is the difference in the present event, and $\Delta VT(i-1)$ is the difference in the last event.

In a step 106, the ECU 32 sets a holding component Dhd. The holding component Dhd is obtained by the learning processing explained above. The holding component Dhd may be a predetermined fixed value.

In a step 107, the ECU 32 sets a threshold VTth. The threshold VTth indicates the predetermined range for determining whether it is in the range where the offsetting function should be canceled. The threshold VTth is varied in accordance with the oil temperature. Alternatively, the engine rotational speed and the load can be used instead of the oil temperature as explained above. The threshold VTth is set greater as the oil temperature increases. In other words, the predetermined range becomes wider as the oil temperature increases. The threshold VTth may be set greater as the engine rotational speed increases. The threshold VTth may be set smaller as the load increases. In general, the threshold VTth is set greater when it is in the range where one of the instable control behavior and the oscillatory behavior is likely occur, i.e., where the response is relatively quick. The threshold VTth is set smaller when it is in the range where one of the instable control behavior and the oscillatory behavior is hardly occurring, i.e., where the response is relatively slow.

In a step 108, it is determined that whether an absolute value of the difference ΔVT is greater than or equal to the threshold VTth. In other words, in the step 108, it is determined whether it is in a range where the control duty should be offset in accordance with the oil temperature. If the absolute value of the difference ΔVT is smaller than the threshold VTth, it is considered that it is not in the range where the control duty should be offset. If the absolute value of the difference ΔVT is equal to or greater than the threshold VTth, it is considered that it is in the range where the control duty should be offset.

In a case that the absolute value of the difference ΔVT is smaller than the threshold VTth, the ECU 32 advances the program to a step 112. In the step 112, the ECU 32 cancels the offset function for the control duty by setting the offset component to 0 (zero).

In a case that absolute value of the difference ΔVT is equal to or greater than the threshold VTth, the ECU 32 advances the program to a step 109. In the step 109, the ECU 32 determines that whether the difference ΔVT is equal to or greater than 0 (zero), i.e., whether the difference ΔVT is positive or not. In other words, it is determined that whether the changing direction, i.e., the controlling direction, is in the advancing direction or not. If the difference ΔVT is equal to or greater than 0 (zero), the changing direction is the advancing direction. If the difference ΔVT is smaller than 0 (zero), the changing direction is the retarding direction.

In a case that the difference ΔVT is equal to or greater than 0 (zero), the ECU 32 advances the program to a step 110. In the step 110, the offset component Dos for the advancing direction is set by looking up a map MAP1 based on the oil temperature, the engine rotational speed, and the load. The offset component Dos in the advancing direction takes positive value. With respect to the oil temperature, the map MAP1 obtains the offset component Dos based on a characteristic identified by ADVANCING in FIG. 6.

In a case that the difference ΔVT is smaller than 0 (zero), the ECU 32 advances the program to a step 111. In the step 111, the offset component Dos for the retarding direction is set by looking up a map MAP2 based on the oil temperature, the engine rotational speed, and the load. The offset component Dos in the retarding direction takes negative value. With respect to the oil temperature, the map MAP2 obtains the offset component Dos based on a characteristic identified by RETARDING in FIG. 6. Therefore, the maps MAP1 and MAP2 are different in characteristics with respect to at least the oil temperature.

The processing in the step 110 and 111 may be replaced with a step of setting a base offset, a step of setting a correcting coefficient, and a step of correcting the base offset by the correcting coefficient. In the base offset setting step, the base offset is set based on the oil temperature only. In the correcting coefficient setting step, the correcting coefficient is set based on at least one of the engine rotational speed and the load by using a predetermined function, such as a map. In the correcting step, the offset component Dos is finally obtained by correcting the base coefficient based on the correcting coefficient.

After setting the offset component Dos in either the step 110, 111, or 112, the ECU 32 advances the program to a step 113. In the step 113, the control duty DUTY is calculated by an expression such as DUTY=Dfb+Dhd+Dos.

In a step 114, the control signal is modulated to have a duty value indicated by the control duty DUTY. Therefore, the control duty DUTY is output to one of the control valves 28 and 29. Then, the corresponding one of the VVTs 18 and 19 is driven and moves in the changing direction, i.e., the controlling direction. As a result, the actual valve timing VT is controlled to approach to the target valve timing VTtg and to be held at the target valve timing VTtg.

Figure 7A:
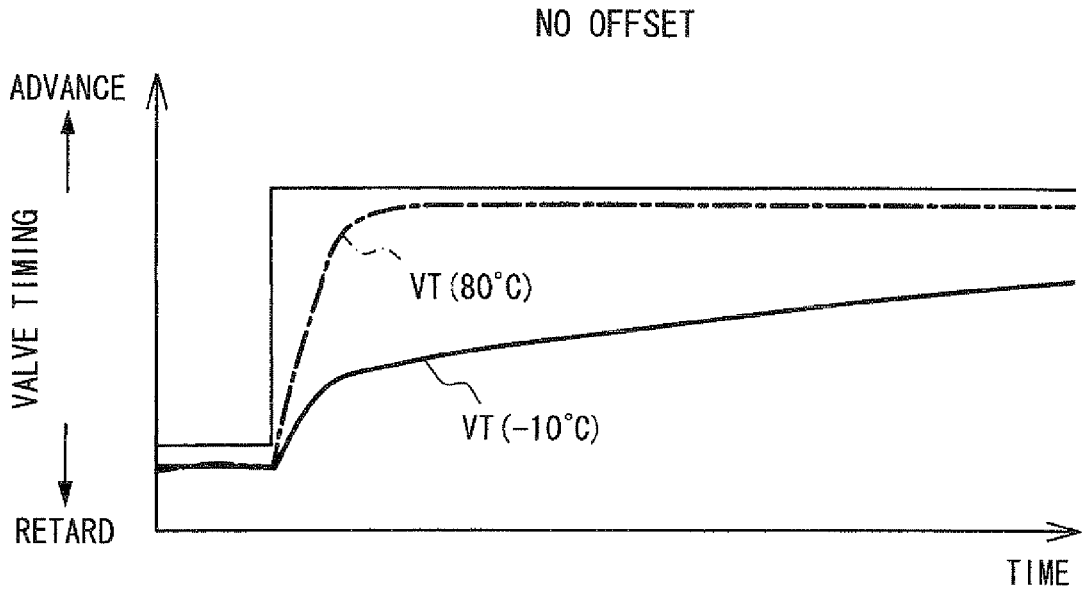
FIG. 7A is a graph showing responses of the variable valve timing device in high and low oil temperature conditions.
Figure 7B:
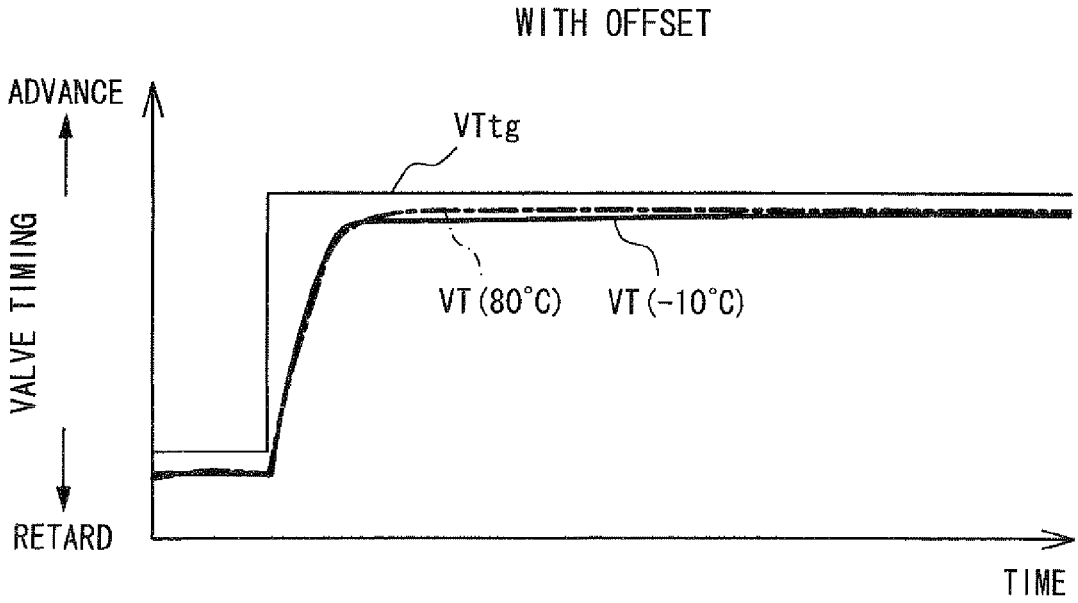
FIG. 7B is a graph showing responses of the variable valve timing device in high and low oil temperature conditions.
Figure 8A:
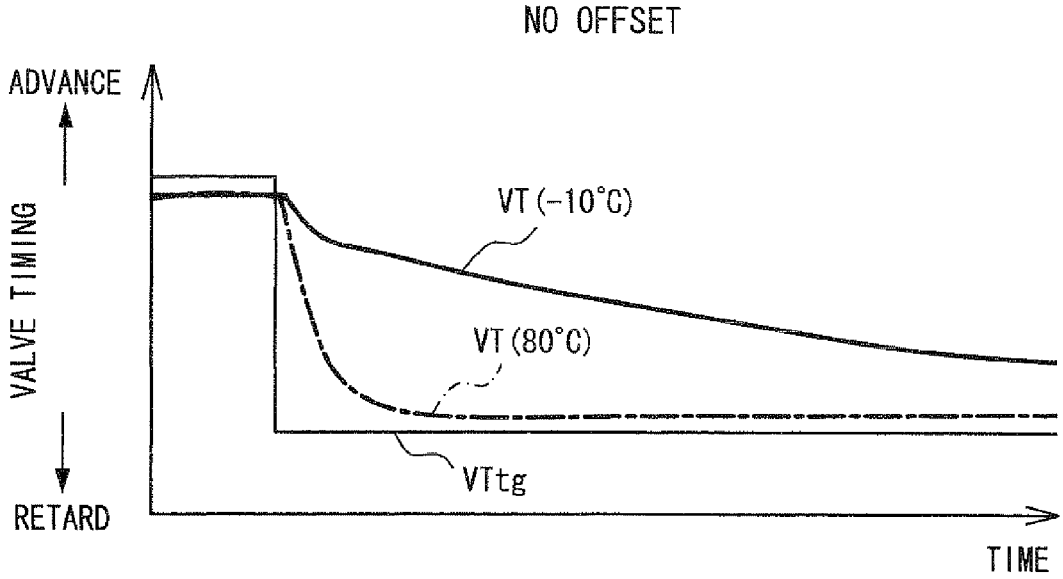
FIG. 8A is a graph showing responses of the variable valve timing device in high and low oil temperature conditions.
Figure 8B:
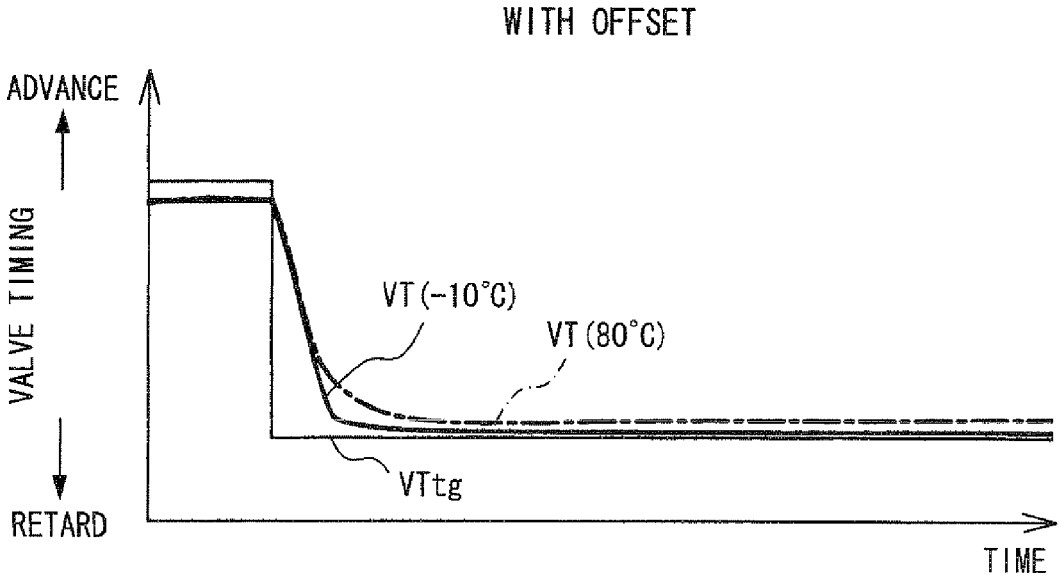
FIG. 8B is a graph showing responses of the variable valve timing device in high and low oil temperature conditions.

Referring to FIGS. 7A, 7B, 8A, and 8B, results of the control are explained. FIGS. 7A and 7B show responses of the actual valve timing VT at the oil temperature in 80° C. and −10° C. in a case that the target valve timing VTtg is changed in the advancing direction as a step manner. FIG. 7A shows a response of the actual valve timing VT with a fixed offset component that is not varied in accordance with the oil temperature. FIG. 7B shows a response of the actual valve timing VT with the offset component in the embodiment. FIGS. 8A and 8B show responses of the actual valve timing VT at the oil temperature in 80° C. and −10° C. in a case that the target valve timing VTtg is changed in the retarding direction as a step manner. FIG. 8A shows a response of the actual valve timing VT with a fixed offset component that is not varied in accordance with the oil temperature. FIG. 8B shows a response of the actual valve timing VT with the offset component in the embodiment.

As shown in FIGS. 7A and 8A, relatively quick responses, the changing speed of the valve timing, can be achieved in the case that the oil temperature is relatively high, such as 80° C., since the oil becomes low viscosity and demonstrates an increased fluidity. However, the responses become considerably slow in the case that the oil temperature is relatively low, such as −10° C., since the oil becomes high viscosity and demonstrates a decreased fluidity.

According to the embodiment, it is possible to improve and accelerate the response in the low oil temperature condition to the response in the high temperature condition. As shown in FIGS. 7B and 8B, the response at −10° C. is improved and accelerated to a level that is almost the same as the response at 80° C. In the other aspect, the response at 80° C. demonstrates a quick and stable response without any oscillatory behavior, such as an overshoot.

As explained above, in the embodiment, the offset component for the control duty is set in accordance with the oil temperature. The offset component is varied to cope with and cancel a change of the dead band width depending upon the oil temperature. It is possible to achieve a proper correction in accordance with the oil temperature to cancel the dead band. As a result, it is possible to achieve both an improved response of the actual valve timing and an improved convergence of the actual valve timing to the target valve timing. More specifically, it is possible to achieve both an improved response in the low temperature condition and a preventing overshoot in the high temperature condition.

In addition, the offset component is obtained based on the different characteristics for the advancing direction and the retarding direction. It is possible to set a proper value for the offset component depending on the changing direction of the valve timing. The offset component is set to reflect a difference between the dead band width in the advancing direction and the dead band width in the retarding direction.

Other Embodiments

The invention is explained based on the embodiment that has two VVTs 18 and 19. It is apparent that the concept explained in the embodiment may be applied to a system that has only one VVT for the intake camshaft or the exhaust camshaft.

The IN-VVT 18 may have the initial position at an intermediate position between the most advanced position and the most retarded position. Also, the EX-VVT 19 may have the initial position at an intermediate position between the most advanced position and the most retarded position.

Instead of the PD feedback, the other known feedback control method, such as the P feedback, the PID feedback, or the optimal regulator feedback, can be used to obtain the feedback component Dfb. The drive train for camshaft may be provided by a timing belt and pulley, or a gear train. Further, the invention may be applied to a variable valve lift device in stead of the variable valve timing device.

Although the present invention has been fully described in connection with the preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A variable valve device system, comprising:

a variable valve device for modulating movement of a valve for an internal combustion engine by using hydraulic fluid pressure;

a control valve operatively connected with the variable valve device to control supplying to and discharging from the hydraulic fluid pressure;

a control device operatively connected with the control valve to control an actual valve movement to a target valve movement by operating the control valve, wherein the control device includes:

means for detecting or estimating a hydraulic fluid temperature;

means for setting an offset component in accordance with the hydraulic fluid temperature; and means for offsetting an operating amount of the control valve by the offset component, wherein the offset component setting means sets the offset component differently depending on controlling directions;

the variable valve device includes a biasing member that biases the variable valve device in a biasing direction that is one of the controlling directions, and the offset component setting means sets the offset component smaller when the controlling direction coincides with the biasing direction than that when the controlling direction opposes the biasing direction.

2. The variable valve device system claimed in claim 1, wherein the control device further includes:

means for detecting at least one of engine rotational speed of the internal combustion engine and load of the internal combustion engine; and means for varying the offset component in accordance with at least one of the engine rotational speed and the load.

3. The variable valve device system claimed in claim 1, wherein the control device further includes means for canceling the offsetting of the operating amount by the offset component when a difference between the actual valve movement and the target valve movement is in a predetermined range.

4. The variable valve device system claimed in claim 3, wherein the canceling means varies the predetermined range in accordance with at least one of a temperature of the hydraulic fluid, an engine rotational speed of the internal combustion engine, and a load of the internal combustion engine.

5. The variable valve device system claimed in claim 1, wherein the offset component setting means sets the offset component in order to shift the operating amount outside a dead band where a changing speed of the variable valve device is relatively slow with respect to the operating amount of the control valve, and wherein the offset component setting means sets the offset component smaller as the hydraulic fluid temperature increases.

6. The variable valve device system claimed in claim 1, wherein the variable valve device is a variable valve timing device including the biasing member that biases the variable valve timing device in one of an advancing direction and a retarding direction.

7. The variable valve device system claimed in claim 3, wherein the predetermined range in the canceling means is narrower than a dead band where a changing speed of the variable valve device is relatively slow with respect to the operating amount of the control valve, and is a range indicative of the actual valve movement being sufficiently close to the target valve movement.

8. The variable valve device system claimed in claim 1, wherein the offset component setting means sets the offset component in order to shift the operating amount outside a dead band where a changing speed of the variable valve device is relatively slow with respect to the operating amount of the control valve, wherein the offset component setting means sets the offset component smaller as the hydraulic fluid temperature increases, wherein the variable valve device is a variable valve timing device including a biasing member that biases the variable valve timing device in a biasing direction that is one of an advancing direction and a retarding direction, wherein the offset component setting means sets the offset component smaller when a controlling direction of the valve movement coincides with the biasing direction than that when the controlling direction opposes the biasing direction, and wherein the control device further includes means for canceling the offsetting of the operating amount by the offset component when a difference between the actual valve movement and the target valve movement is in a predetermined range that is narrower than the dead band, and is a range indicative of actual valve movement being sufficiently close to target valve movement.

9. A method for controlling actual valve movement to target value movement in a variable valve device for modulating movement of a valve for an internal combustion engine by using hydraulic fluid pressure by using a control valve operatively connected with the variable valve device to control supplying to and discharging from the hydraulic fluid pressure, said method comprising:

detecting or estimating a hydraulic fluid temperature;

setting an offset component in accordance with the hydraulic fluid temperature; and offsetting an operating amount of the control valve by the offset component, wherein the offset component is set differently depending on controlling directions;

a biasing member is provided that biases the variable valve device is a biasing direction that is one of the controlling directions, and the offset component is set to be smaller when the controlling direction coincides with the biasing direction than that when the controlling direction opposes the biasing direction.

10. The method of claim 9, wherein:

at least one of engine rotational speed of the internal combustion engine and load of the internal combustion engine is detected; and the offset component is varied in accordance with at least one of the engine rotational speed and the load.

11. The method of claim 9, wherein offsetting of the operating amount by the offset component is cancelled when a difference between the actual valve movement and the target valve movement is in a predetermined range.

12. The method of claim 11, wherein the predetermined range is varied in accordance with at least one of a temperature of the hydraulic fluid, an engine rotational speed of the internal combustion engine, and a load of the internal combustion engine.

13. The method of claim 9, wherein the offset component is set in order to shift the operating amount outside a dead band where a changing speed of the variable valve device is relatively slow with respect to the operating amount of the control valve, and wherein the offset component is set to be smaller as the hydraulic fluid temperature increases.

14. The method of claim 9, wherein the variable valve timing device is biased in one of an advancing direction and a retarding direction.

15. The method of claim 11, wherein the predetermined range is narrower than a dead band where a changing speed of the variable valve device is relatively slow with respect to the operating amount of the control valve, and is a range indicative of the actual valve movement being sufficiently close to the target valve movement.

16. The method of claim 9, wherein the offset component is set in order to shift the operating amount outside a dead band where a changing speed of the variable valve device is relatively slow with respect to the operating amount of the control valve, wherein the offset component is set to be smaller as the hydraulic fluid temperature increases, wherein the variable valve device is a variable valve timing device including a biasing member that biases the variable valve timing device in a biasing direction that is one of an advancing direction and a retarding direction, wherein the offset component is set to be smaller when a controlling direction of the valve movement coincides with the biasing direction than when the controlling direction is opposed to the biasing direction, and wherein offsetting of the operating amount by the offset component is cancelled when a difference between actual valve movement and target valve movement is in a predetermined range that is narrower than the dead band, and is a range indicative of actual valve movement being sufficiently close to the target valve movement.

* * * * *